US007609242B2

(12) United States Patent
Kuo et al.

(10) Patent No.: US 7,609,242 B2
(45) Date of Patent: Oct. 27, 2009

(54) LIQUID CRYSTAL DISPLAY AND INTEGRATED DRIVING CIRCUIT THEREOF

(75) Inventors: Min-Chien Kuo, Changhua County (TW); Chi-Mao Hung, Chiayi (TW)

(73) Assignee: AU Optronics Corp., Hsin-Chu (TW)

( * ) Notice: Subject to any disclaimer, the term of this patent is extended or adjusted under 35 U.S.C. 154(b) by 822 days.

(21) Appl. No.: 11/212,878

(22) Filed: Aug. 29, 2005

(65) Prior Publication Data

US 2006/0208989 A1 Sep. 21, 2006

(30) Foreign Application Priority Data

Mar. 15, 2005 (TW) ..... 94107931 A

(51) Int. Cl.
*G09G 3/36* (2006.01)

(52) U.S. Cl. ..... 345/87; 345/99; 345/204; 345/211; 345/212; 345/691

(58) Field of Classification Search ..... 345/87–104, 345/204–215, 690–697
See application file for complete search history.

(56) References Cited

U.S. PATENT DOCUMENTS

| | | | | |
|---|---|---|---|---|
| 6,414,676 | B1 * | 7/2002 | Boigues | 345/213 |
| 7,394,209 | B2 * | 7/2008 | Lin et al. | 315/247 |
| 2004/0119426 | A1 | 6/2004 | Suk | |
| 2004/0119667 | A1 | 6/2004 | Yang | |
| 2005/0174818 | A1 * | 8/2005 | Lin et al. | 363/98 |
| 2006/0208989 | A1 * | 9/2006 | Kuo et al. | 345/98 |

* cited by examiner

*Primary Examiner*—Vijay Shankar
(74) *Attorney, Agent, or Firm*—Bacon & Thomas, PLLC

(57) ABSTRACT

A liquid crystal display apparatus includes a liquid crystal display module, an integrated driving circuit, and a power supply circuit. The integrated driving circuit is used for driving the liquid crystal display module to display video frames according to a video signal. The integrated driving circuit includes a pulse width modulation (PWM) control circuit for generating N PWM signal sequentially, where N is a positive integer. The power supply circuit is employed to output N DC voltage signals sequentially. A part of the N DC voltage signals is applied to the liquid crystal display module and another part of the N DC voltage signals is applied to the integrated driving circuit.

13 Claims, 5 Drawing Sheets

LIQUID CRYSTAL DISPLAY AND INTEGRATED DRIVING CIRCUIT THEREOF

This application claims the benefit of Taiwan application Serial No. 94107931, filed Mar. 15, 2005, the subject matter of which is incorporated herein by reference.

BACKGROUND OF THE INVENTION

1. Field of the Invention

The invention relates in general to a liquid crystal display, and more particularly to a driving circuit into which pulse width modulation control circuits are integrated for a liquid crystal display.

2. Description of the Related Art

Referring to FIG. 1, the structure of a conventional liquid crystal display 100 is illustrated. The liquid crystal display 100 includes a video signal processor 102, a timing control circuit 104, a power supply circuit 106 and a liquid crystal display (LCD) module 108.

The LCD module 108 includes a data driving circuit, a scanning driving circuit, and a pixel matrix (not shown in FIG. 1). In order to convert a received video signal, for example a composite video baseband signal (CVBS) signal, to RGB data for the data driving circuit, the video signal processor 102 requires operating voltages of +5V, +3.3V, and +7.5V, for example. The +5V voltage is provided by an external power source and is used to provide the +3.3V voltage additionally through the conversion of the +5V voltage by a voltage regulator. The timing control circuit 104 is used for controlling the data driving circuit and scanning driving circuit in order for the pixel matrix to display video frames. The scanning driving circuit requires operating voltages of +15V and −10V so as to output scanning signals to the pixel matrix. The +15V voltage is defined as a highest level of voltage for scanning signals, VGH and the −10V voltage is defined as a lowest level of voltage for scanning signals, VGL.

Since the liquid crystal display 100 requires operating voltages of +7.5V, −10V, and +15V in addition to operating voltages of +5V and +3.3V, the power supply circuit 106 includes three DC-to-DC converters for supplying the voltages of +7.5V, −10V, and +15V, correspondingly. The liquid crystal display 100 therefore requires a PWM control circuit 110 to drive the three DC-to-DC converters (not shown in FIG. 1).

During a power supply process of the conventional liquid crystal display 100, the PWM control circuit 110 outputs PWM control signals to the power supply circuit 106 in arbitrary sequence. In response to the startup of the liquid crystal display 100, the power supply circuit 106 simultaneously outputs operating voltages of +15V and −10V for powering the scanning driving circuit as well as other operating voltages for powering logic circuits. If the application of the operating voltage of +15V to the scanning driving circuit is earlier than that of the operating voltages for powering logic circuits, an unexpected bulk current would be generated in a short time in the scanning driving circuit. In such situation, the scanning driving circuit would be damaged.

In addition, unexpected symbols would display during the startup of the liquid crystal display 100 if the operating voltages for powering logic circuits and operating voltages of +15V and −10V for powering the scanning driving circuit are provided at the same time. In response to the operating voltages for powering the scanning driving circuit, the scanning driving circuit generates scanning signals to the pixel matrix while the video signal processor 102 has not outputted pixel data to the data driving circuit, thus resulting in the display of unexpected things, such as unexpected symbols.

Accordingly, the structure of the conventional liquid crystal display 100 has the following disadvantages. In terms of costs, the liquid crystal display 100's requirement of at least three integrated circuits, for example, the video signal processor 102, timing control circuit 104, and PWM control circuit 110, increases the production costs. In terms of stability, the design using the liquid crystal display 100 would damage the scanning driving circuit or results in the display of unexpected things in some circumstances.

SUMMARY OF THE INVENTION

It is therefore an object of the invention to provide a liquid crystal display and an integrated driving circuit thereof to achieve a reduced number driving circuits and thus cost reduction. In addition, during the power supply process, probability of the damage to the scanning driving circuit is reduced and the problem of display of unexpected things can be avoided.

The invention achieves the above-identified object by providing a liquid crystal display apparatus. The liquid crystal display apparatus includes a liquid crystal display module, an integrated driving circuit, and a power supply circuit. The integrated driving circuit is used for driving the liquid crystal display module to display video frames according to a video signal. The integrated driving circuit includes a pulse width modulation (PWM) control circuit for generating N PWM signals sequentially, where N is a positive integer. The power supply circuit is employed to output N DC voltage signals sequentially. A first part of the N DC voltage signals is applied to the liquid crystal display module and a second part of the N DC voltage signals is applied to the integrated driving circuit.

The invention achieves the above-identified object by providing an integrated driving circuit for use in a liquid crystal display apparatus. The liquid crystal display apparatus includes a liquid crystal display module and a power supply circuit. The power supply circuit outputs N DC voltages sequentially according to N pulse width modulation (PWM) signals, where N is a positive integer. The integrated driving circuit includes a video processor, a timing control circuit, and a PWM control circuit. The video processor is used for generating pixel data to the liquid crystal display module according to a video signal. The timing control circuit is used for controlling the liquid crystal display module in order to display video frames. When the integrated driving circuit is enabled, the PWM control circuit generates the N PWM signals sequentially, wherein a part of the N DC voltages is applied to the liquid crystal display module and another part of the N DC voltages is applied to the integrated driving circuit.

Other objects, features, and advantages of the invention will become apparent from the following detailed description of the preferred but non-limiting embodiments. The following description is made with reference to the accompanying drawings.

DETAILED DESCRIPTION OF THE INVENTION

According to the invention, embodiments of a liquid crystal display and an integrated driving circuit thereof are provided to achieve a reduced number driving circuits and thus cost reduction. In addition, the probability of the damage to the scanning driving circuit can be reduced and the display of unexpected things, in the power supply process at startup, can be avoided by modifying pulse width modulation (PWM) signals outputted by the integrated driving circuit as well as their delay times among one another through changing the capacitance value of an external capacitor of the integrated driving circuit.

Figure 1:
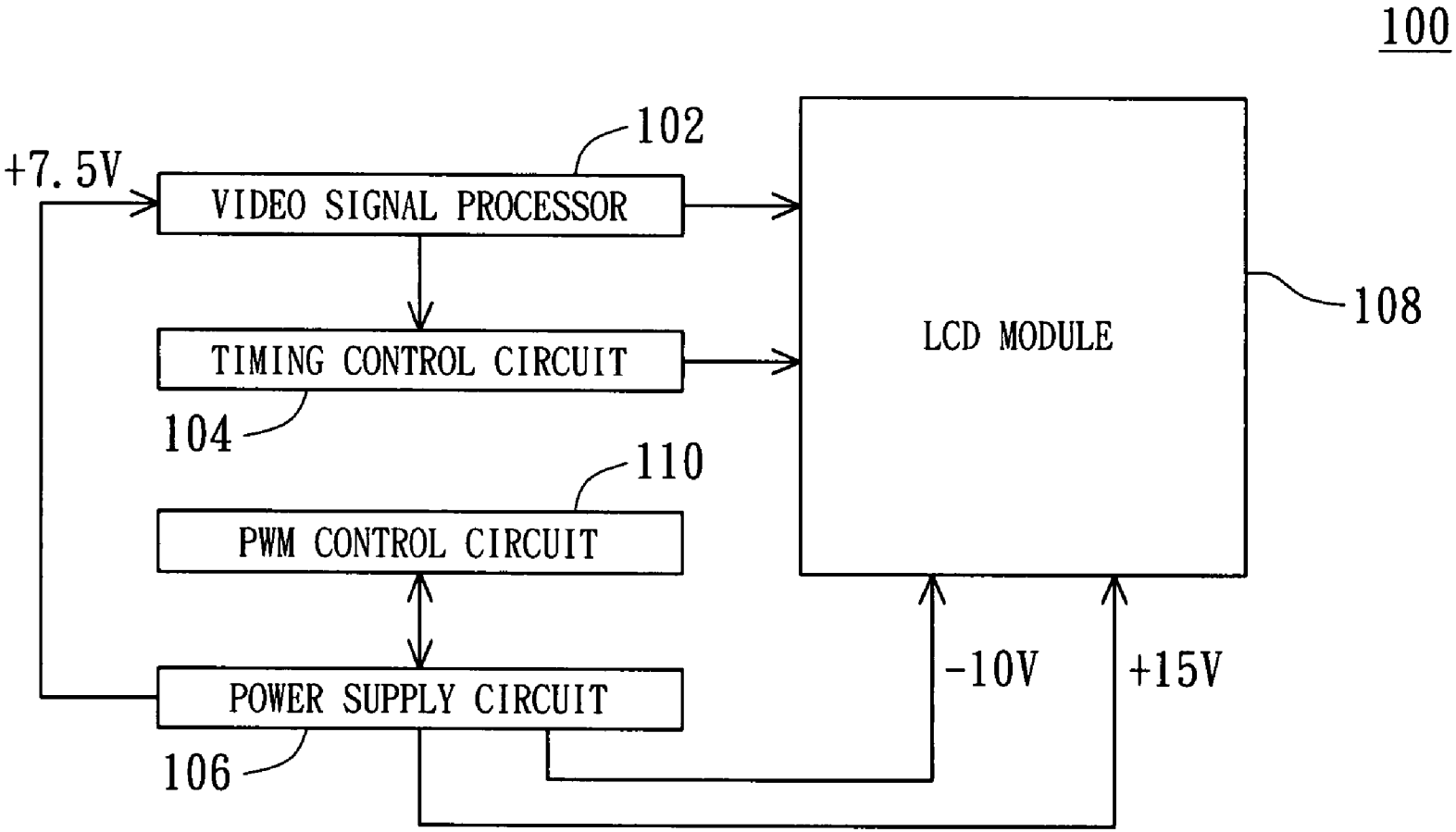
FIG. 1(RELATED ART)
FIG. 1 (Related Art) illustrates a structure of a conventional liquid crystal display.
Figure 2:
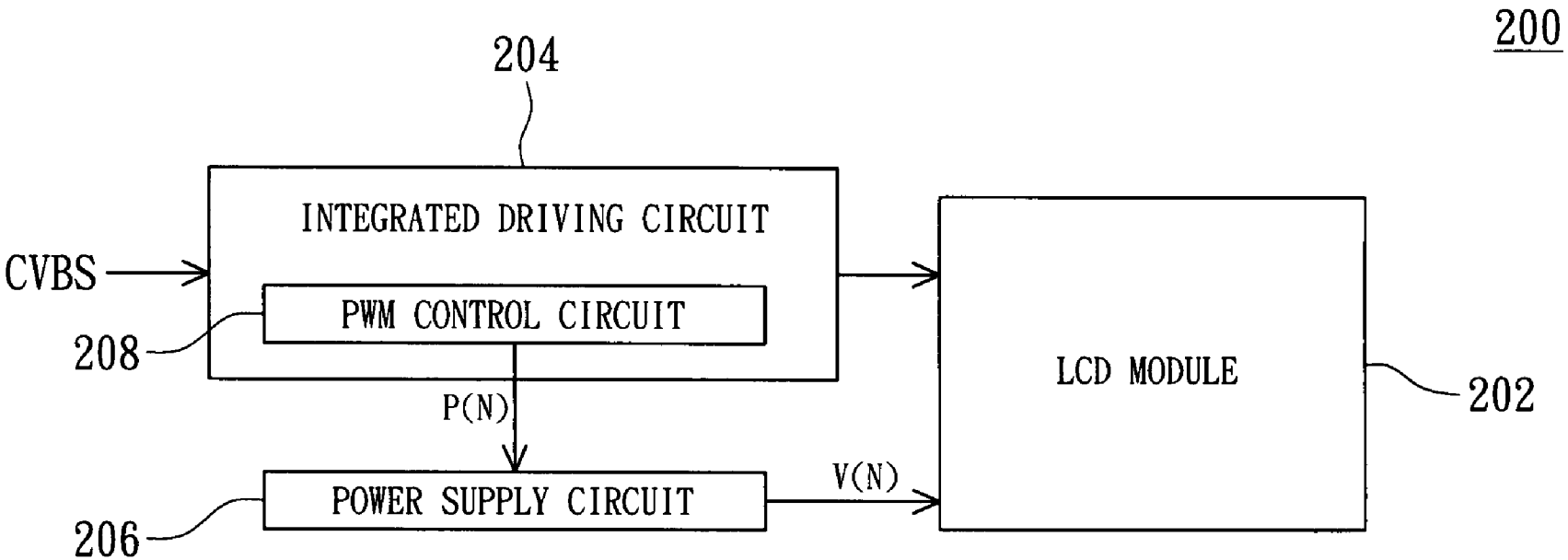
FIG. 2 illustrates a structure of a liquid crystal display according to an embodiment of the invention.

Referring to FIG. 2, the structure of a liquid crystal display 200 according to an embodiment of the invention is shown. The liquid crystal display 200 includes an LCD module 202, an integrated driving circuit 204, and a power supply circuit 206. The integrated driving circuit 204 drives the LCD module 202 to display video frames according to a video signal, for example, CVBS, Y/C, RGB, or Y/Cb/Cr signal. The integrated driving circuit 204 includes a PWM control circuit 208. The PWM control circuit 208 sequentially generates N PWM signals, denoted by P(N). The power supply circuit 206 generates N DC voltages, denoted by V(N), according to the N PWM signal P(N). A part of the N DC voltages V(N) is applied to the LCD module 202 while another part of the N DC voltages V(N) is applied to the integrated driving circuit 204.

Figure 3:
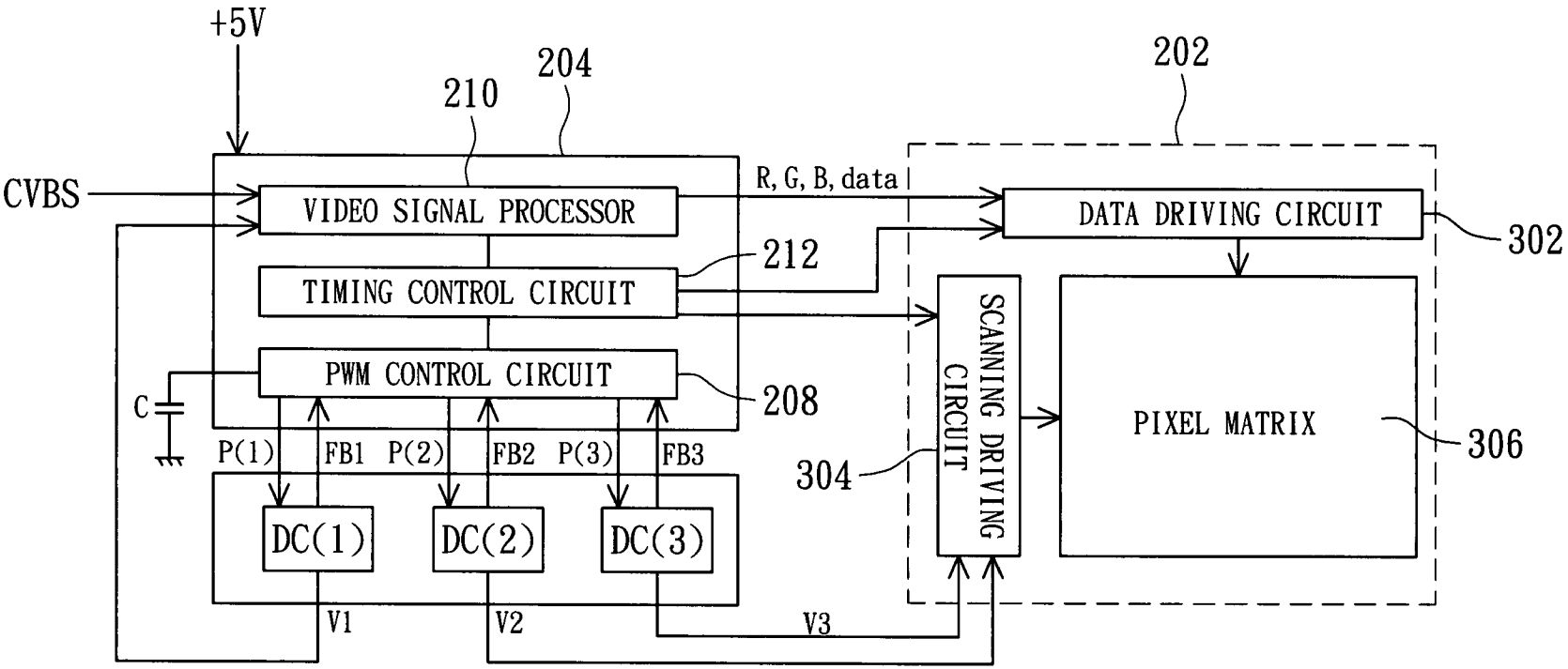
FIG. 3 is a block diagram of the liquid crystal display shown in FIG. 2.

Referring to FIG. 3, the structure of the liquid crystal display 200 is shown in a block diagram. The LCD module 202 includes a data driving circuit 302, a scanning driving circuit 304, and a pixel matrix 306 coupled to the data driving circuit 302 and the scanning driving circuit 304. The integrated driving circuit 204 further includes a video signal processor 210, a timing control circuit 212, a phase locked loop, and an inter-IC (12C) interface (the phase locked loop and 12C interface both not shown in FIG. 3 for the sake of brevity). In order to operate, the integrated driving circuit 204 receives operating voltages of +5V and +3.3V generated by an external power source, wherein the operating voltage of +3.3V is used for the operation of logic circuits inside the integrated driving circuit 204 for example, and is generated by the conversion of the +5V input from the external power source into an output voltage of +3.3V through a voltage regulator (not shown in FIG. 3) for example. The video signal processor 210 includes a video processor and an RGB processor (both not shown in FIG. 3). According to a video signal, for example, a CVBS signal, the video signal processor 210 generates pixel data, such as red, green, and blue (RGB) data to the data driving circuit 302. The data driving circuit 302 generates pixel voltages to the pixel matrix 306 according to the pixel data. The timing control circuit 212 is employed to control the operation of the data driving circuit 302 and scanning driving circuit 304 in order for the data driving circuit 302 and scanning driving circuit 304 to drive the pixel matrix 306 to display video frames. The phase locked loop generates a timing signal for the operation of the timing control circuit 212.

The above-mentioned N PWM signals includes a first PWM signal P(1), a second PWM signal P(2), and a third PWM signal P(3) where N is equal to 3. The PWM control circuit 208 outputs the PWM signals P(1), P(2), and P(3) sequentially to the power supply circuit 206. The power supply circuit 206 further includes three DC-to-DC converters, namely, a first DC-to-DC converters DC(1), a second DC-to-DC converters DC(2), and a third DC-to-DC converters DC(3).

The first DC-to-DC converters DC(1) is used for receiving the first PWM signal P(1) and outputting a first DC voltage V1 and a first feedback signal FB1. The integrated driving circuit 204 uses the first DC voltage V1 to operate. The second DC-to-DC converters DC(2) is used for receiving the second PWM signal P(2) and outputting a second DC voltage V2 and a second feedback signal FB2. The scanning driving circuit 304 uses the second DC voltage V2 to operate. The third DC-to-DC converters DC(3) is used for receiving the third PWM signal P(3) and outputting a third DC voltage V3 and a third feedback signal FB3. The scanning driving circuit 304 uses the third DC voltage V3 to operate.

Figure 4:
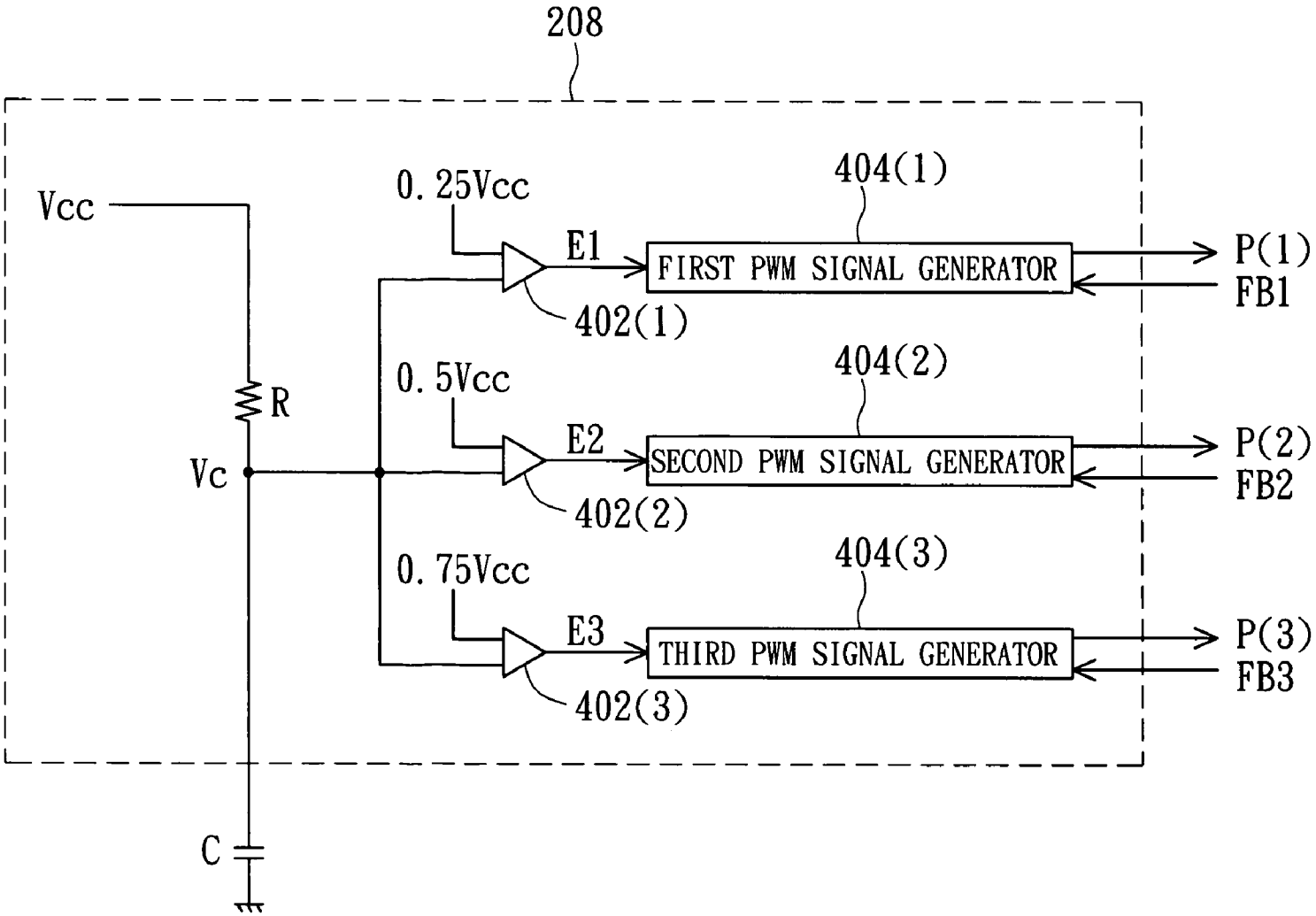
FIG. 4 is a schematic diagram showing a pulse width modulation control circuit according to an embodiment of the invention.

Referring to FIG. 4, a PWM control circuit according to an embodiment of the invention is shown. The PWM control circuit 208 includes a resistor R, first comparator 402(1), second comparator 402(2), third comparator 402(3), first PWM signal generator 404(1), second PWM signal generator 404(2), and third PWM signal generator 404(3). A first terminal of the resistor R is selectively connected to a first voltage $V_{CC}$ of +5V, for example, while the another terminal, the second terminal, is coupled to a first fixed voltage, for example the ground voltage, via the external capacitor C, the voltage across which is referred to as capacitor voltage $V_C$. When the first voltage $V_{CC}$ is applied to the first terminal of the resistor R, the capacitor C begins to be charged and the capacitor voltage $V_C$ rises gradually.

The first comparator 402(1) is used for outputting a first control signal E1. The second comparator 402(2) is used for outputting a second control signal E2. The third comparator 402(3) is used for outputting a third control signal E3. When the first control signal E1 is enabled, the first PWM signal generator 404(1) generates the first PWM signal P(1) according to the first feedback signal FB1. When the second control signal E2 is enabled, the second PWM signal generator 404(2) generates the second PWM signal P(2) according to the second feedback signal FB2. When the third control signal E3 is enabled, the third PWM signal generator 404(3) generates the third PWM signal P(3) according to the third feedback signal FB3.

Figure 5:
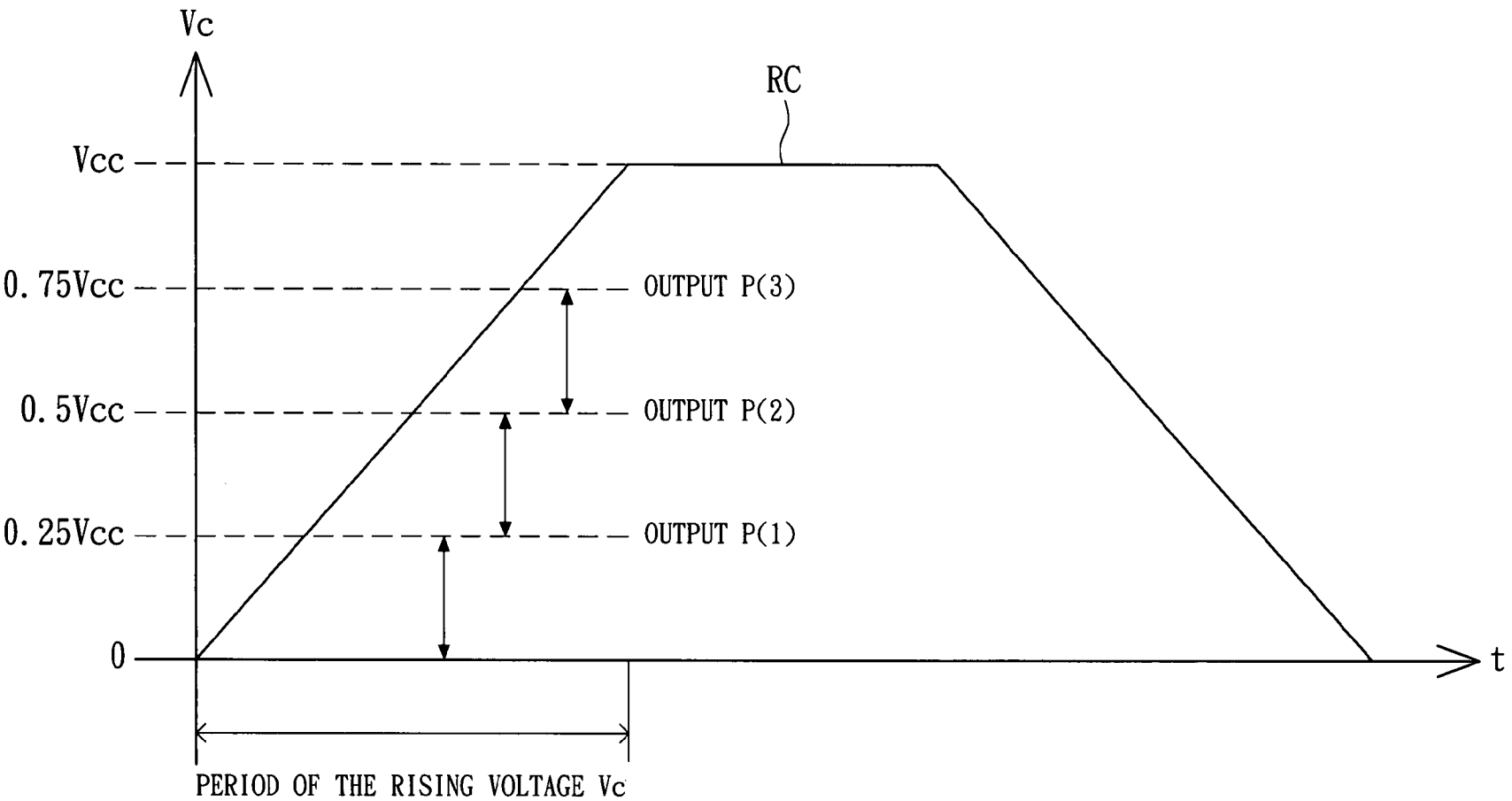
FIG. 5 is a timing diagram illustrating the relationships between the generation of pulse width modulation (PWM) signals and corresponding capacitor voltage Vc.

When the PWM control circuit 208 operates and begins to receive the first voltage $V_{CC}$ of +5V, the external capacitor C is charged by the first voltage through the resistor R. The slope of the capacitor voltage $V_C$ with respect to time is determined by the resistance value of the resistor R and the capacitance value of the external capacitor C. FIG. 5 shows a timing diagram illustrating the relationships between the generation of the PWM signals and the capacitor voltage $V_C$. As observed from the curve RC of the capacitor voltage $V_C$ in FIG. 5, when the capacitor voltage $V_C$ exceeds a first reference voltage, for example a voltage of $0.25V_{CC}$, i.e. 0.25 times the first voltage $V_{CC}$, the first comparator 402(1) asserts the first control signal E1.

When the first control signal E1 is enabled, the first DC-to-DC converter DC(1) outputs the first DC voltage V1 to the integrated driving circuit 204, for example a DC voltage V1 of +7.5V to the video signal processor 210 of the integrated driving circuit 204, in order for the video signal processor 210 to generate R, G, B data. Meanwhile, the first DC-to-DC converter DC(1) outputs the first feedback signal FB1 to the first PWM signal generator 404(1) in order for the first PWM signal generator 404(1) to modify the conducting period of the first PWM signal P(1) according to the first feedback signal FB1. In this way, the first DC-to-DC converter DC(1) maintains a stable first DC voltage V1 of +7.5V at its output.

In addition, when the capacitor voltage $V_C$ rises and exceeds a second reference voltage, for example a voltage of $0.5V_{CC}$, the second comparator 402(2) asserts the second control signal E2.

When the second control signal E2 is enabled, the second DC-to-DC converter DC(2) outputs the second DC voltage V2 to the scanning driving circuit 304, for example a DC voltage V2 of −10V, in order for the scanning driving circuit 304 to output the lowest level of voltage for scanning signals, VGL. Meanwhile, the second DC-to-DC converter DC(2) outputs the second feedback signal FB2 to the second PWM signal generator 404(2) in order for the second PWM signal generator 404(2) to modify the conducting period of the second PWM signal P(2) according to the second feedback signal FB2. In this way, the second DC-to-DC converter DC(2) maintains a stable second DC voltage V2 of −10V at its output.

When the capacitor voltage $V_C$ rises and exceeds a third reference voltage, for example a voltage of $0.75V_{CC}$, the third comparator 402(3) asserts the third control signal E3. When the third control signal E3 is enabled, the third DC-to-DC converter DC(3) outputs the third DC voltage V3 to the scanning driving circuit 304, for example a DC voltage V3 of +15V, in order for the scanning driving circuit 304 to output the highest level of voltage for scanning signals VGH and the third feedback signal FB3. After that, an operating voltage of +5V is sufficient for the liquid crystal display 200 except its backlight module driving circuit.

The integrated driving circuit disclosed above avoids unexpected operations happened in a power supply process during startup. When the liquid crystal display 200 is starting up, operating voltages of +5V and +3.3V by the external power source are first applied to corresponding circuits of the liquid crystal display 200 so that the external capacitor C begins to be charged by the +5V input. Hence, driving circuits in the scanning driving circuit 304 will be supplied with first an operating voltage of +3.3V for logic operations, secondly a second DC voltage V2 of −10V, and thirdly the third DC voltage of +15V. By doing so, the driving circuits in the scanning driving circuit 304 are protected from an unexpected bulk current in a short time because of logic signals not generated. Therefore, the generation of an unexpected bulk current in a short time, as happened in the convention approach due to an improper power supply sequence of the operating voltages, can be avoided.

Further, another power supply sequence can be used to avoid the display of unexpected symbols resulting from earlier enabling of the scanning signals but video data having not applied to the data driving circuit 302. The video signal processor 210 can sufficiently prepare video data signals before the enabling of the scanning signals by first applying the first DC voltage V1 of +7.5V to the video signal processor 210. After that, the scanning driving circuit 304 is supplied with the second DC voltage of −10V and the third DC voltage of +15V. In this way, the problem of the display of unexpected symbols due to the improper power supply sequence of the operating voltages, as happened in the convention approach, can be avoided. Furthermore, according to the invention, modifying the capacitance value of the external capacitor C enables the integrated driving circuit 204 to control the delay times of the PWM signals P(1), P(2), and P(3) among one another, thus bringing flexibility in changing the delay times.

The above embodiments disclose a liquid crystal display and an integrated driving circuit. According to the invention, an integrated driving circuit, for example in integrated circuit form, and a power supply circuit are sufficient to drive a liquid crystal display module. Manufacturing costs can be greatly reduced in this way. In addition, the design of the PWM control circuit reduces the probability of damaging of the scanning driving circuit and avoids the problem of display of unexpected symbols during startup.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An integrated driving circuit for use in a liquid crystal display apparatus including a liquid crystal display module and a power supply circuit, the power supply circuit being adapted to provide N DC voltages sequentially according to N pulse width modulation (PWM) signals, N being a positive integer, the integrated driving circuit comprising:

a video signal processor for generating pixel data applied to the liquid crystal display module according to a video signal;

a timing control circuit for controlling the liquid crystal display module in order to display video frames; and a PWM control circuit for generating the N PWM signals sequentially according to N feedback signals outputted by the power supply circuit when the integrated driving circuit is enabled;

wherein parts of the N DC voltages are applied to the liquid crystal display module and another parts of the N DC voltages are applied to the integrated driving circuit.

2. The integrated driving circuit according to claim 1, wherein the N PWM signals include a first PWM signal, a second PWM signal, and a third PWM signal, and the PWM control circuit comprises:

a resistor having a first terminal and a second terminal, the first terminal selectively receiving a first fixed voltage and the second terminal being coupled to a second fixed voltage via an external capacitor, the external capacitor having a capacitor voltage, wherein when the first terminal of the resistor begins to receive the first fixed voltage, the external capacitor is being charged so that the capacitor voltage rises;

a first comparator for providing a first control signal, wherein when the capacitor voltage exceeds a first reference voltage, the first control signal is enabled;

a second comparator for providing a second control signal, wherein when the capacitor voltage exceeds a second reference voltage, the second control signal is enabled;

a third comparator for providing a third control signal, wherein when the capacitor voltage exceeds a third reference voltage, the third control signal is enabled;

a first PWM generator for generating the first PWM signal after the first control signal is enabled;

a second PWM generator for generating the second PWM signal after the second control signal is enabled; and a third PWM generator for generating the third PWM signal after the third control signal is enabled.

3. The integrated driving circuit according to claim 2, wherein the N DC voltages include a first DC voltage, a second DC voltage, and a third DC voltage, and the power supply circuit comprises:

a first DC-to-DC converter for receiving the first PWM signal and outputting the first DC voltage, wherein the first DC voltage is applied to the integrated driving circuit for operation;

a second DC-to-DC converter for receiving the second PWM signal and outputting the second DC voltage, wherein the second DC voltage is applied to the liquid crystal display module for operation; and a third DC-to-DC converter for receiving the third PWM signal and outputting the third DC voltage, wherein the third DC voltage is applied to the liquid crystal display module for operation.

4. The integrated driving circuit according to claim 3, wherein the first reference voltage is lower than the second reference voltage and the second reference voltage is lower than the third reference voltage.

5. A liquid crystal display apparatus comprising:

a liquid crystal display module;

an integrated driving circuit for driving the liquid crystal display module to display video frames according to a video signal, the integrated driving circuit comprising:

a pulse width modulation (PWM) control circuit for generating N PWM signals sequentially, where N is a positive integer; and a power supply circuit for outputting N DC voltages sequentially according to the N PWM signals, a first set of the N DC voltages being applied to the liquid crystal display module and a second set of the N DC voltages being applied to the integrated driving circuit.

6. The liquid crystal display apparatus according to claim 5, wherein the liquid crystal display module comprises a data driving circuit, a scanning driving circuit, and a pixel matrix coupled to the data driving circuit and the scanning driving circuit.

7. The liquid crystal display apparatus according to claim 6, wherein the integrated driving circuit further comprises:

a video signal processor for generating pixel data applied to the data driving circuit according to the video signal; and a timing control circuit for controlling the data driving circuit and scanning driving circuit to drive the pixel matrix.

8. The liquid crystal display apparatus according to claim 7, wherein the N PWM signals include a first PWM signal, a second PWM signal, and a third PWM signal, and the PWM control circuit comprises:

a resistor having a first terminal and a second terminal, the first terminal selectively receiving a first fixed voltage and the second terminal being coupled to a second fixed voltage via an external capacitor, the external capacitor having a capacitor voltage, wherein when the first terminal of the resistor begins to receive the first fixed voltage, the external capacitor is being charged so that the capacitor voltage rises;

a first comparator for providing a first control signal, wherein when the capacitor voltage exceeds a first reference voltage, the first control signal is enabled;

a second comparator for providing a second control signal, wherein when the capacitor voltage exceeds a second reference voltage, the second control signal is enabled;

a third comparator for providing a third control signal, wherein when the capacitor voltage exceeds a third reference voltage, the third control signal is enabled;

a first PWM generator for generating the first PWM signal after the first control signal is enabled;

a second PWM generator for generating the second PWM signal after the second control signal is enabled; and a third PWM generator for generating the third PWM signal after the third control signal is enabled.

9. The liquid crystal display apparatus according to claim 8, wherein the N DC voltages include a first DC voltage, a second DC voltage, and a third DC voltage, and the power supply circuit comprises:

a first DC-to-DC converter for receiving the first PWM signal and outputting the first DC voltage, wherein the first DC voltage is applied to the integrated driving circuit for operation;

a second DC-to-DC converter for receiving the second PWM signal and outputting the second DC voltage, wherein the second DC voltage is applied to the scanning driving circuit for operation; and a third DC-to-DC converter for receiving the third PWM signal and outputting the third DC voltage, wherein the third DC voltage is applied to the scanning driving circuit for operation.

10. The liquid crystal display apparatus according to claim 9, wherein the first reference voltage is lower than the second reference voltage and the second reference voltage is lower than the third reference voltage.

11. The liquid crystal display apparatus according to claim 5, wherein the power supply circuit is also adapted to receive the N PWM signals.

12. The liquid crystal display apparatus according to claim 5, wherein the power supply circuit is also adapted to output N feedback signals according to the N PWM signals.

13. The liquid crystal display apparatus according to claim 12, wherein the PWM control circuit is also adapted to output the N PWM signals according to the N feedback signals.

* * * * *

UNITED STATES PATENT AND TRADEMARK OFFICE

CERTIFICATE OF CORRECTION

PATENT NO. : 7,609,242 B2
APPLICATION NO. : 11/212878
DATED : October 27, 2009
INVENTOR(S) : Kuo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1094 days.

Signed and Sealed this

Twelfth Day of October, 2010

David J. Kappos

David J. Kappos
*Director of the United States Patent and Trademark Office*